United States Patent [19]

Golben et al.

[11] 4,402,187

[45] Sep. 6, 1983

[54] HYDROGEN COMPRESSOR

[75] Inventors: Peter M. Golben, Wyckoff; Matthew J. Rosso, Jr., Ringwood, both of N.J.

[73] Assignee: MPD Technology Corporation, Wyckoff, N.J.

[21] Appl. No.: 377,553

[22] Filed: May 12, 1982

[51] Int. Cl.[3] ..... F17C 11/00

[52] U.S. Cl. ..... 62/48; 62/467 R; 123/DIG. 12; 165/DIG. 17; 423/248

[58] Field of Search ..... 62/48, 467 R, 102; 165/DIG. 17; 123/1 A, DIG. 12; 423/248

[56] References Cited

U.S. PATENT DOCUMENTS

| | | | |
|---|---|---|---|
| 3,732,690 | 5/1973 | Meijer | 123/1 A |
| 4,085,590 | 4/1978 | Powell et al. | 60/673 |
| 4,161,211 | 7/1979 | Duffy et al. | 62/48 |
| 4,165,569 | 8/1979 | Mackay | 62/48 |
| 4,178,987 | 12/1979 | Bowman et al. | 62/48 |
| 4,185,979 | 1/1980 | Woolley | 62/48 |
| 4,188,795 | 2/1980 | Terry | 62/102 |
| 4,200,144 | 4/1980 | Sirovich | 165/1 |
| 4,281,969 | 8/1981 | Doub, Jr. | 62/467 |

*Primary Examiner*—Ronald C. Capossela
*Attorney, Agent, or Firm*—Francis J. Mulligan, Jr.; Raymond J. Kenny

[57] ABSTRACT

Discloses a hydrogen compressor having two series of chambers or hydride containers specifically located in a pair of jackets adapted to contain flowing heat exchange liquid, e.g. water. The series of chambers are connected through a check valve arrangement and flow of hot and cold water through said jackets is controlled by a timing means.

6 Claims, 5 Drawing Figures

HYDROGEN COMPRESSOR

TECHNICAL FIELD

The invention relates to hydrogen compressors in general and more particularly to absorption-desorption compressors operable on energy provided by at least one heat source and at least on heat sink at moderate temperatures with a relatively small difference in temperature therebetween.

BACKGROUND OF THE ART

Theoretical and quasi-practical disclosures are set forth in least U.S. Pat. No. 4,200,144 and 4,188,795 as to means whereby three or even more reversibly hydridable materials can be used at two or more temperatures to raise the pressure of hydrogen for heat transfer purposes. There are, of course, other uses to which high pressure hydrogen can be put and the inherent characteristics of an adsorption-desorption hydrogen compressor are advantageous. Despite this, to applicants' knowledge, no one has as yet provided the art with a hydrogen compressor of practical, inexpensive, safe design which can operate on the energy present in widely available waste heat streams, i.e., hot water at temperatures between about 50° C. and 100° C.

Because no one has as yet provided the art with such a practical absorption-desorption hydrogen compressor, the art has used mechanical compressors which are noisy and which wear out fast because of high speed of operation and difficulty with lubrication. Compared to a prototype compressor of the present invention, a comparable mechanical compressor is 3 times its volume, 5 times its weight and twice its cost.

SUMMARY OF THE INVENTION

The disclosed invention has for its object and contemplates a hydrogen compressor comprising an inlet for hydrogen gas fed at a low inlet pressure and on outlet for hydrogen gas at high pressure and therebetween at least two sets of connected units A, C and E and at least two sets of units serving unit functions B, D and F. A through F are:

A. a first chamber in communication with said inlet through a one-way valve adapted to admit hydrogen gas into the chamber at the low inlet pressure containing a first hydridable material having an adsorption pressure below said low inlet pressure at a first temperature.

B. heat exchange means associated with said first chamber adapted to operate alternately to maintain said first chamber at or below the first temperature and to raise the temperature of the first chamber to a second temperature higher than the first temperature C. a second chamber in communication with the first chamber through a one-way valve adapted to prevent flow of hydrogen from said second chamber to said first chamber and containing a second hybridable material forming a less stable hydride that the first hydridable material and having a plateau pressure at a temperature below the second temperature less than the plateau pressure of said first hydridable material at the second temperature D. heat exchange means associated with the second chamber adapted to operate alternately to maintain the second chamber at a temperature lower than the second temperature and at a third temperature higher than the first temperature E. a third chamber in communication with the second chamber through a one-way valve adapted to prevent flow of hydrogen from the third chamber to the second chamber and in communication with said outlet and containing a third hydridable material forming a less stable hydride than said second hydridable material and having a plateau pressure at a temperture below the third temperature less than the plateau pressure of the second hydridable material at the third temperature F. heat exchange means associated with said third chamber adapted to operate alternately to maintain the third chamber at a temperature lower than the third temperature and at a fourth temperature higher than the first temperature. and control means for alternating the temperature capability of heat exchange means B, D and F to maintain the lower of the two specified temperatures when hydrogen is being absorbed by the hydridable material in the associated chamber and at the higher of the two specified temperatures when hydrogen is present in and being desorbed from the hydridable material in the associated chambers.

Advantageously the aforedescribed compressor is operated from a heat sink and a heat source, the heat sink being at or about room temperature, i.e. 20°-25° and the heat source being at a temperature in the range of about 50° C. to 100° C. and the units serving as heat exchange means B, D and F are two tubular structures jacketing one each of units A, C and E. The reversibly hydridable materials used in compressors of the present invention are advantageously intermetallic compounds of the $AB_5$ type where A is calcium or rare earth and B is nickel or cobalt with other materials being substitutable for A and B in significant amounts while retaining the basic crystal structure of $AB_5$. Also materials such as Fe-Ti, $Mg_2Cu$, $Mg_2Ni$ and other intermetallic compounds can be used as hydridable materials.

BEST MODE OF CARRYING OUT THE INVENTION

Figure 1:
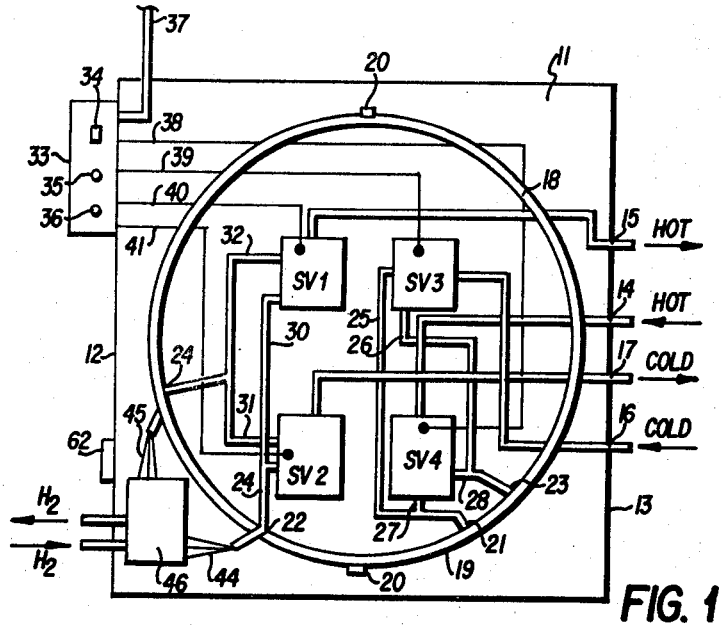
FIG. 1 is a schematic plan view of a hydrogen compressor of the present invention.

Referring now to the drawing, FIG. 1 depicts a schematic plan view of the working components a prototype hydrogen compressor of the present invention contained in a box perhaps 61 cm by 61 cm by 25 cm. As depicted in the drawing the compressor is supported on base 11 connected to front panel 12. Essentially this specific compressor is designed to operate at only two temperatures and is supplied through back panel 13 with hot and cold fluid, e.g. water passing through hot water entrance port 14, hot water exit port 15, cold water entrance port 16 and cold water exit port 17. These ports connect through appropriate lines to servovalves SV1 SV2, SV3 and SV4. Specifically, entering cold water is supplied to SV3, entering hot water is supplied to SV4, exiting cold water passes through SV2 and exiting hot water passes through SV1. Supported on base 11 are a pair of coiled water jackets 18 (first jacket) and 19 (second jacket) by brackets 20. In this particular prototype, first jacket 18 directly overlies second jacket 19 and each comprises a circular coil of about two turns roughly 50 cm in diameter of copper tubing having an outside diameter of about 2.9 cm. Water flows in jacket 18 from entry port 21 to exit port 22. Water flows in jacket 19 from entry port 23 to exit port 24. Cold water supplied to servo-valve SV3 can be selectively supplied to jackets 18 and 19 through lines 25 and 26 and hot water supplied to servo-valve SV4 can be selectively supplied to jackets 18 and 19 through lines 27 and 28. Water is withdrawn from jacket 18 through port 22, cold water exiting through SV2 by means of line 29 and hot water exiting through SV1 through line 30. In like manner water is withdrawn from jacket 19 through port 24, cold water exiting through SV2 by means of line 31 and hot water exiting through SV1 through line 32. Control of servo-valves SV1, SV2, SV3 and SV4 in this prototype is by time, timing means (not depicted) being housed in control box 33 mounted on front panel 12 which also provides a mounting platform for on-off switch 34 and valve indicator lamps 35 and 36. Power for the servo-valves and indicating lamps is provided by electrical mains 37 and power and control signals are distributed to the servo-valves in a conventional manner by wire means 38, 39, 40 and 41.

Hydrogen gas at low pressure enters the compressor at entry port 42 and exits at higher pressure through exit port 43. Between entry port 42 and exit port 43 hydrogen gas flows into and out of one of two series of three hydride containers as disclosed hereinafter. The hydride containers are in the form of elongated tubular structures positioned inside jackets 18 and 19 and thus do not appear in FIG. 1. Gas lines collectively, 44 and 45 lead to hydride containers in jacket 18 and jacket 19 respectively from check valve network 46 depicted schematically in FIG. 1 as a box which does not in reality exist. Check valve network 46 which also connects with hydrogen entry port 42 and hydrogen exit port 43 is shown schematically in more detail in FIG. 2.

Figure 2:
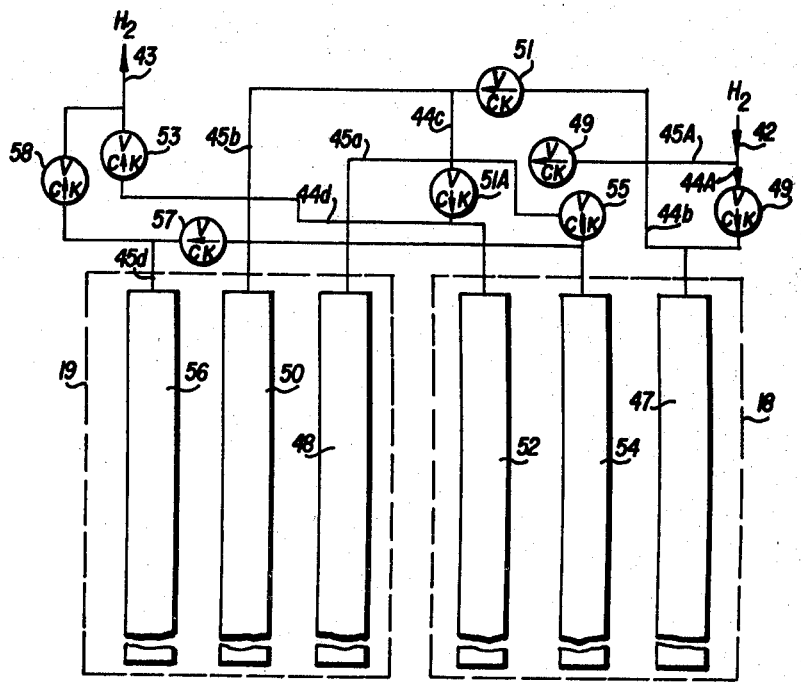
FIG. 2 is a detailed schematic of the gas containment and valving arrangement in a compressor of the present invention.

Referring now to FIG. 2 gaseous hydrogen enters through port 42 and lines 44*a* and 45*a* to hydride containers 47 and 48 respectively. Hydride containers 47 and 48 contain a hydridable material which, of the materials used in the compressor forms the most stable hydride. Lines 44*a* and 45*a* contain check valves 49 (sometimes called one-way valves or taps) which prevent flow of hydrogen gas out entry port 42. After combining with, and being released from the hydridable material in container 47 hydrogen gas flows through line 44*b* which connects with line 45*b* and flows into hydride container 50 which contains the hydridable material of the hydridable materials used in the compressor which forms the next most stable hydride. Line 44*b* contains check valve 51 which prevents flow of hydrogen back into container 47. Again after combination with and release from the hydride in container 50, hydrogen gas is caused to flow through line 45*b* which connects to line 44*c* into hydride container 52. Line 44*c* contains check valve 51A which prevents flow of hydrogen back into container 50. Hydride container 52 contains the hydridable material which forms, of the materials used in the compressor, the least stable hydride. After combining with and being released from the hydridable material in container 52 hydrogen flows through line 44*d* to hydrogen exit port 43. Line 44*d* includes check valve 53 which prevents flow of hydrogen from exit port 43 into container 52.

In a similar manner hydrogen gas which has combined with and been released from the hydridable material in container 48 flows out through line 45*a* and by means of line 45*c* into hydride container 54. Check valve 55 in line 45*c* prevents flow of hydrogen from container 54 to container 48. Container 54 contains the same hydridable material as container 50. After hydrogen gas has been combined with and released from the hydride in container 54, it passes through line 45*c* which connects with line 45*d* and flows into hydride container 56. Hydride container 56 contains the same hydride as container 52. After hydrogen has been absorbed into and released from this hydride it passes through line 45*d* to hydrogen exit port 43. Check valves 57 and 58 prevent flow of hydrogen from container 56 to container 54 and from exit port 43 to container 56 respectively.

Figure 3:
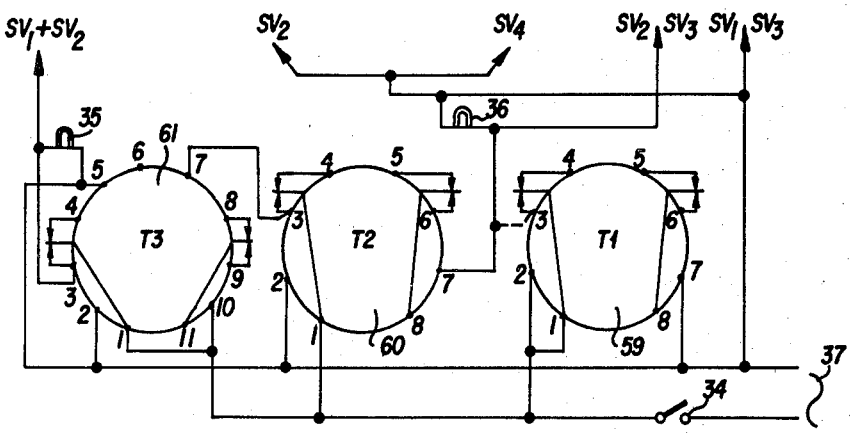
FIG. 3 is a diagram of a control mechanism employed in the compressor of the present invention.

In speaking of absorbtion by and release from a hydridable material of hydrogen gas, it is to be observed that in the compressor as depicted in FIG. 1, the absorption takes place at the lower of two temperatures provided by the water supply and the release of hydrogen from the hydride compound takes place at the higher of two temperatures. Alternately the hydride containers in the two jackets are heated and cooled. The heating and cooling cycles are controlled by timers in box 33. A timing device actually used in the prototype compressor is depicted in FIG. 3. Referring now thereto electromechanical timer T1 (59) is employed for repeat cycle of hot and cold. Electro-mechanical timers T2 (60) and T3 (61) are employed for on delay and off delay respectively. The circuit as depicted, when timers are properly set can provide for a delay of the order of 10 seconds in activation of servo-valve SV1 in passing hot water to hot water exit port 15. The purpose of this is to permit hot water entering either jacket 18 or 19 to displace cold water therein and forcing that cold water through exit port 17 before actuating to engage the line to exit port 15. In the particular construction of the prototype compressor hot water is externally recirculated from exit port 15 to entrance port 14 through a heat source not illustrated. If heat conservation is not required this delay timing feature can be eliminated. Alternatively thermostatic controls of conventional nature can be substituted for the delay timing device when recirculation is used.

Figure 4:
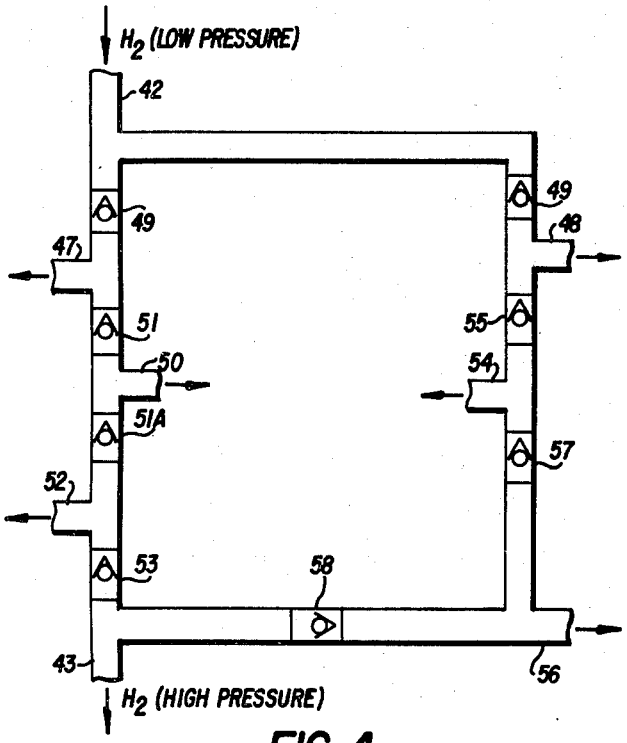
FIG. 4 is a quasi-pictorial view of a valving arrangement in a compressor of the present invention.

A more pictorial view of the check valve network 46 is shown in FIG. 4. Referring now thereto check valve network 46 is disclosed to be a series of T-connectors, check valve units and tubing through which hydrogen flows from low pressure port 42 to high pressure port 43. At high pressure port 43 a back pressure relief valve may be employed or it may not. Likewise at or near low pressure port 42 and/or high pressure port 43 taps can be employed so as to fit pressure gages to the system. A typical pressure gage mounting location 62 is depicted on FIG. 1 of the drawing.

Figure 5:
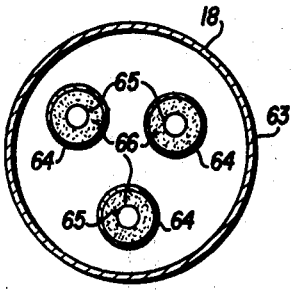
FIG. 5 is a cross-sectional view within a heat exchange jacket in a compressor of the present invention.

The heart of the compressor of the present invention is the particular arrangement of jacket and hydride containers which comprises the heat exchange units. An exaggerated cross-sectional view of jacket 18 and containers 47, 54 and 52 is shown in FIG. 5. Referring now thereto, jacket 18 is depicted as a metal tube 63 (but is not necessarily metal) and containers 47, 54 and 52 as having a metal sheath 64 an inner core of gas space defined by an axially extending wire coil or spring 65 and a mass of hydridable material 66 between spring 65 and sheath 64. This container structure is more fully described in a prior U.S. application filed in the names of Peter Mark Golben and Warren Storms on Sept. 21, 1981. Except for the specific nature of the hydridable material present, the construction of containers 47, 54 and 52 is identical and the entire structure within jacket 18 is duplicated within jacket 19. Those skilled in the art will appreciate that while FIG. 5 depicts three containers within a jacket, more containers used either in series or parallel can be employed. While not depicted in FIG. 5, it is to be observed that containers 47, 52 and 54 dead end within jacket 18 and the single line to each of these containers and the gas space defined by spring 65 are employed for both entering and exiting hydrogen. It is still further to be observed that a good portion of the efficient operation of the compressor of the present invention is due not only to the design of containers 47, 52, 54, etc. but also to the total container jacket design. Jacket 18 is elongated, (about 300 cm in length) and the containers are only a slight bit shorter. The space in jacket 18 not taken up by the containers is filled with water, cold sometimes hot at others and generally always flowing. The relative length and diameter of jacket 18 and the water flow rates are chosen so that not only the heat transfer factors are observed but also so that water flows from one end to the other of jacket 18 in a turbulent manner but in a plug-like fashion. By this is meant that when water of one temperature is caused to displace water of another temperature in jacket 18, there is relatively little mixing of the hot and cold water. The water being displaced flows in front of the displacing water and the exit of jacket 18 is subjected to a high slope temperature gradient when the plug of displaced water passes therethrough. In this manner, rapid change from heat source to heat sink is possible along with short cycle times and efficient recycling of heat source water.

A prototype compressor of the present invention has employed $LaNi_5$ as the hydridable material in containers 47 and 48, $MNi_{4.5}Al_{0.5}$ in containers 50 and 54 and $MNi_{4.15}Fe_{0.85}$ in containers 52 and 56. M means mischmetal This prototype is fed with hydrogen at a pressure of about 3.4 atmospheres and discharges it at a pressure of about 35 atmospheres with an average flow rate of about 28 standard liters per minute (slpm). Total inventory of hydridable material in the compressor is about 2.4 kg divided into 0.4 kg units in each container. Water flow is about 8 l/min at inlet temperatures of 20° C. and 75° C. with a $\Delta T$ (change in temperature between inlet and outlet) of about 2° in centigrade units. One half cycle time (time for hydrogen to flow in or out of a container, e.g. container 47) is about 1.8 minutes. In the prototype, the jacket contains about 1060 ml of heat transfer fluid (water) and about 656 ml of container volume. With the normal water flow rates used in operation of the prototype compressor, the cold or hot water plug driven from the jackets when temperature is changed from the heat source to the heat sink mode or vice versa is about 7.5 to 8 seconds.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A hydrogen compressor comprising an inlet for hydrogen gas fed at a low inlet pressure and an outlet for hydrogen gas at high pressure, therebetween at least two sets of connected units A, C and E and at least two sets of units serving the unit functions B, D and F said A through F being A. a first chamber in communication with said inlet through a one-way valve adapted to admit hydrogen gas into said first chamber at said low inlet pressure containing a first hydridable material having an adsorption pressure below said low inlet pressure at a first temperature B. heat exchange means associated with said first chamber adapted to operate alternately to maintain said first chamber at or below said first temperature and to raise the temperature of said first chamber to a second temperature higher than said first temperature C. a second chamber in communication with said first chamber through a one-way valve adapted to prevent flow of hydrogen from said second chamber to said first chamber and containing a second hydridable material forming a less stable hydride than said first hydridable material and having a plateau pressure at a temperature below said second temperature less than the plateau pressure of said first hydridable material at said second temperature D. heat exchange means associated with said second chamber adapted to operate alternately to maintain said second chamber at a temperature lower than said second temperature and at a third temperature higher than said first temperature E. a third chamber in communication with said second chamber through a one-way valve adapted to prevent flow of hydrogen from said third chamber to said second chamber and in communication with said outlet and containing a third hydridable material forming a less stable hydride the said second hydridable material and having a plateau pressure at a temperature below said third temperature less than the plateau pressure of said second hydridable material at said third temperature F. heat exchange means associated with said third chamber adapted to operate alternately to maintain said third chamber at a temperature lower than said third temperature and at a fourth temperature higher than said first temperature and control means for alternating the temperature capability of heat exchange means B, D and F to maintain the lower of the two specified temperatures when hydrogen is being adsorbed by the hydridable material in the associated chambers and at the higher of the two specified temperatures when hydrogen is present in and being desorbed from the hydridable material in the associated chambers.

2. A hydrogen compressor as in claim 1 wherein heat exchange means B, E and F are adapted to alternate between only one high temperature and one low temperature.

3. A hydrogen compressor as in claim 1 wherein heat exchange means B, E and F comprise a pair of elongated jackets each containing one each of chambers A, C and E.

4. A hydrogen compressor as in claim 3 wherein chamber A in a first jacket of said pair is connected in series to chamber C in the second jacket of said pair and chamber E in said first jacket of said pair and chamber A in said second jacket of said pair is connected in series to chamber C in said first jacket of said pair and chamber E in said second jacket of said pair.

5. A hydrogen compressor as in claim 1 wherein said chambers comprise elongated, dead end tubes having hydridable material held against the wall thereof by an axially and centrally located coil spring defining an axial hydrogen gas passage.

6. A compressor as in claim 1 wherein reversible hydridable materials in said units A, C and E are metallic hydridable materials.

* * * * *